US011812795B2

(12) United States Patent
Damir et al.

(10) Patent No.: US 11,812,795 B2
(45) Date of Patent: Nov. 14, 2023

(54) SWADDLING DEVICE

(71) Applicant: SwaddleDesigns, LLC, Seattle, WA (US)

(72) Inventors: Lynette Damir, Seattle, WA (US); Jeffrey Damir, Seattle, WA (US)

(73) Assignee: SwaddleDesigns, LLC, Seattle, WA (US)

( * ) Notice: Subject to any disclaimer, the term of this patent is extended or adjusted under 35 U.S.C. 154(b) by 43 days.

(21) Appl. No.: 15/982,911

(22) Filed: May 17, 2018

(65) Prior Publication Data

US 2018/0332902 A1 Nov. 22, 2018

Related U.S. Application Data

(60) Provisional application No. 62/507,742, filed on May 17, 2017.

(51) Int. Cl.
*A41B 13/06* (2006.01)

(52) U.S. Cl.
CPC ..... *A41B 13/06* (2013.01); *A41B 2300/322* (2013.01); *A41B 2400/22* (2013.01); *A41B 2500/20* (2013.01); *A41B 2500/50* (2013.01)

(58) Field of Classification Search
CPC ..... A41B 13/06; A41B 13/00; A41B 2400/22; A41B 2500/20; A41B 2500/50;
(Continued)

(56) References Cited

U.S. PATENT DOCUMENTS

D59,012 S 9/1921 Kelly
2,496,922 A 2/1950 Virtue
(Continued)

FOREIGN PATENT DOCUMENTS

WO 2007/098558 9/2007

OTHER PUBLICATIONS

International Search Report and Written Opinion of the International Searching Authority completed Sep. 14, 2018, in International Patent Application No. PCT/US2018/033268, 4 pages.
(Continued)

*Primary Examiner* — Khoa D Huynh
*Assistant Examiner* — Abby M Spatz
(74) *Attorney, Agent, or Firm* — Lowe Graham Jones PLLC; Ellen M. Bierman

(57) ABSTRACT

A swaddling device is described. The swaddling device is Y-shaped pod shaped and configured to substantially enclose a baby. The device includes sleeves having at their ends foldover mitten cuffs or similar selectively openable fasteners. The cuffs allow a caregiver to expose the hand or hands of the baby so as to provide skin-to-skin contact. Alternatively, the caregiver can close the cuffs if scratching is a concern. The device is shaped to provide support and snugness for the baby in its mid-section, while also providing sufficient space for hips and knees to flex. The design of the Swaddle Sack with swaddle snugness provides support and partial suppression of the Moro Reflex without arm restraints and allowing sufficient range of motion for baby's upper section which will reduce risk of suffocation for baby in the event that baby rolls over to prone position, because baby will be able to use his or her arms to reposition his or her head to get access to air.

18 Claims, 12 Drawing Sheets

(58) Field of Classification Search
CPC ... A41B 2300/322; A41B 13/08; A41B 13/10; A41B 2300/32; A47D 15/008; A47G 9/083; A47G 9/0223; A61F 5/3784
USPC ..... 2/69.5, 111, 114, 75; 128/873
See application file for complete search history.

(56) References Cited

U.S. PATENT DOCUMENTS

| | | | | |
|---|---|---|---|---|
| D163,809 | S | 7/1951 | Lehigh | |
| D168,887 | S | 2/1953 | Friedman | |
| 2,677,130 | A * | 5/1954 | O'Hayer | A41B 13/00 2/114 |
| D296,378 | S | 6/1988 | Coates | |
| 4,901,371 | A | 2/1990 | Christians | |
| 5,129,406 | A | 7/1992 | Magnusen et al. | |
| 5,621,917 | A | 4/1997 | Howsden | |
| D413,423 | S | 9/1999 | Forrest | |
| D446,907 | S | 8/2001 | Hall et al. | |
| D514,279 | S | 2/2006 | Lindquist | |
| 7,246,392 | B2 | 7/2007 | Schmid et al. | |
| D650,153 | S | 12/2011 | Chopak et al. | |
| D669,659 | S | 10/2012 | Barski | |
| 8,607,364 | B2 | 12/2013 | Barski | |
| D716,526 | S | 11/2014 | Harris | |
| 8,898,833 | B2 | 12/2014 | Coates | |
| 9,003,564 | B2 | 4/2015 | Wynh | |
| D728,198 | S | 5/2015 | Barski | |
| D728,199 | S | 5/2015 | Barski | |
| 9,119,423 | B2 | 9/2015 | Gotel et al. | |
| 9,179,711 | B2 | 11/2015 | Krawchuk | |
| D772,532 | S | 11/2016 | Karp | |
| D801,630 | S | 11/2017 | Wollschlaeger et al. | |
| D802,252 | S | 11/2017 | Sack | |
| D802,253 | S | 11/2017 | Sack | |
| D806,354 | S | 1/2018 | Calodoukas | |
| 2011/0180079 | A1* | 7/2011 | Krawchuk | A41B 13/06 128/873 |
| 2012/0047621 | A1 | 3/2012 | Bocchino | |
| 2014/0165257 | A1 | 6/2014 | Wynh | |
| 2015/0000036 | A1* | 1/2015 | Krawchuk | A41D 11/00 5/413 R |
| 2016/0113331 | A1* | 4/2016 | Blacker | A41B 13/06 2/80 |
| 2016/0128392 | A1 | 5/2016 | Krawchuk | |
| 2016/0174619 | A1 | 6/2016 | Waters et al. | |
| 2016/0353809 | A1 | 12/2016 | Barski | |
| 2017/0311663 | A1 | 11/2017 | Wollschlaeger et al. | |
| 2018/0332902 | A1 | 11/2018 | Damir et al. | |
| 2019/0208831 | A1 | 7/2019 | Joshi | |
| 2019/0254355 | A1 | 8/2019 | Griffin | |

OTHER PUBLICATIONS

International Search Report and Written Opinion of the International Searching Authority dated May 16, 2019, in International Patent Application No. PCT/US2019/016435, 8 pages.

* cited by examiner

SWADDLING DEVICE

PRIORITY CLAIM

This application claims the benefit of priority from U.S. Provisional Patent Application No. 62/507,742, entitled "SWADDLING DEVICE," filed on May 17, 2017, the entire content of which is incorporated herein by reference in its entirety.

TECHNICAL FIELD

The present disclosure relates to a swaddling device for infants.

BACKGROUND

Typical prior art swaddling devices do not allow a baby to have skin-to-skin access to his or her hands. An example prior swaddling pod design that prevents baby from accessing his or her hands is described in U.S. Pat. No. 8,607,364. This prior swaddling pod design, which prevents access to baby's hands to suck and self-soothe, is not in baby's best interest, because it is very important for baby to have access to its hands.

Another example prior swaddling pod design is described in U.S. Pat. No. 9,179,711. The described design is a sleeping sack that allows baby to suck on its hands through the fabric of the sack, but without direct skin-to-skin access. This prior swaddling pod design, which requires baby to suck through the fabric, is not ideal or in baby's best interest, because skin-to-skin contact is more natural. In addition, if baby is sucking on fabric then baby will be ingesting residual detergent or fabric softeners on the fabric after washing and drying the garment.

In addition, other prior art swaddling device designs restrain baby's arms with a large wrap feature, typically including a hook-and-loop fastener. Such designs can be dangerous, because if baby rolls over and lands face down on the sleeping surface or mattress, the arm restraints will restrict baby's movements and prevent baby from lifting his or her upper body to reposition head and get access to air.

DETAILED DESCRIPTION

Figure 1A:
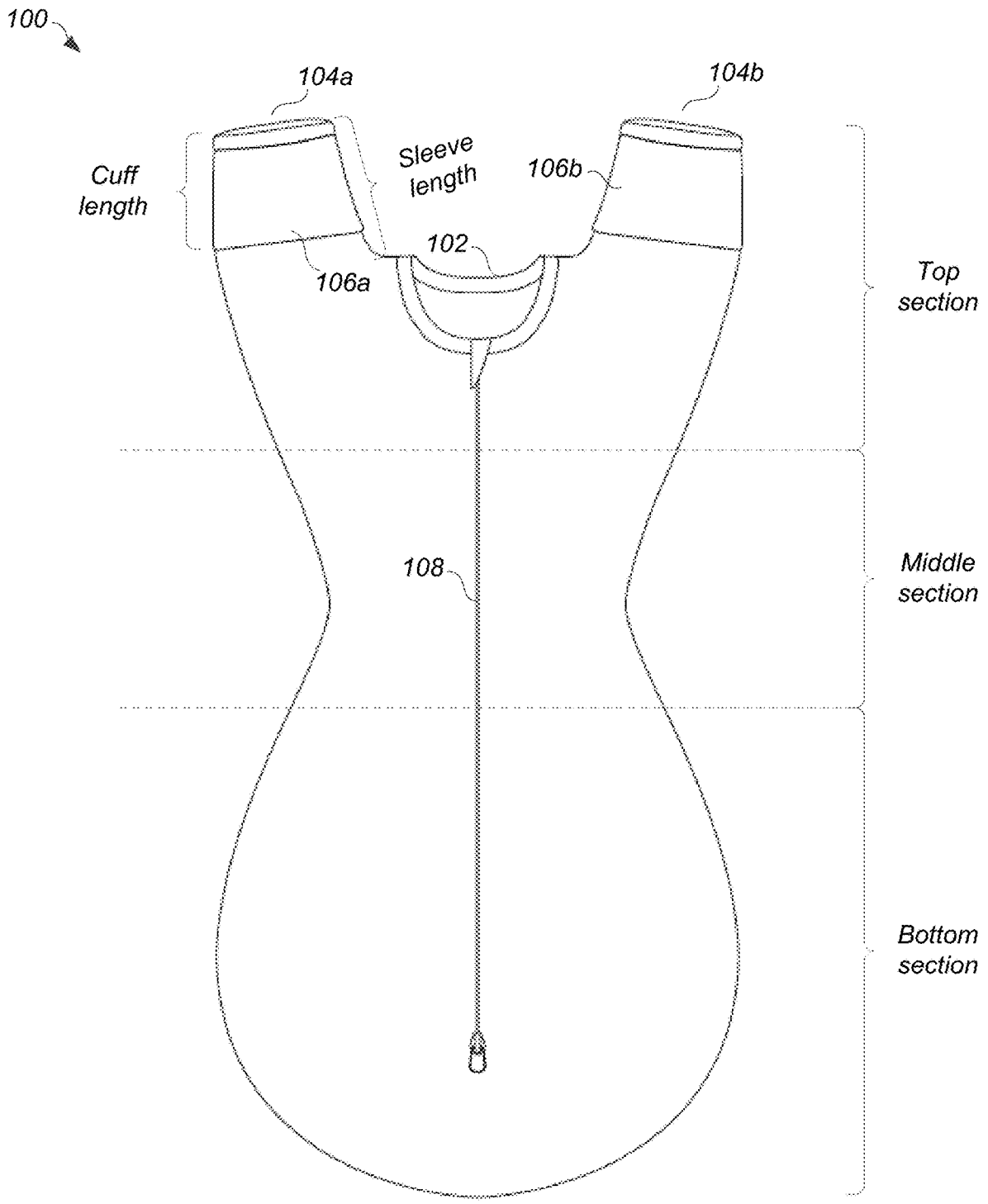
FIGS. 1A and 1B are line drawings showing front and rear views of a swaddling device according to a first embodiment, where its cuffs are in an open position.

Embodiments described herein provide a swaddling device, sometimes referred to as a Swaddle Sack. The Swaddle Sack is an innovative swaddle pod, wearable blanket, sleeping sack with uniquely modified and shaped sleeves with foldover mitten cuffs to allow baby to have full access to hands to self-soothe, and the design supports multiple natural arm position options for baby.

The Swaddle Sack innovative design provides the support of a swaddle with the benefits of ease of use for the caregiver. The Swaddle Sack includes foldover mitten cuffs, an important innovation that allows the caregiver two options for providing baby access to his or her hands. In a first option, the Swaddle Sack allows the baby to have skin-to-skin (hand to mouth, hand to hand, hand to face) access to his or her hands via the foldover mitten cuffs in the open position. In a second option, the Swaddle Sack allows the hand opening to be closed via the foldover mitten cuff should the caregiver choose to do so, and baby can still bring hands to face for self-comfort.

The Swaddle Sack foldover mitten cuff feature is innovative and important because other available swaddling pod designs do not allow baby to have skin-to-skin access to his or her hands. As discussed above, prior art swaddling pods, swaddling wraps, and similar devices do not allow for skin-to-skin contact with baby's hands. In contrast, in the open cuff position, the Swaddle Sack provides ample opportunity for baby to access and experience skin-to-skin contact with his or her hands.

The Swaddle Sack foldover mitten cuff feature is further innovative because other available sleeping sack designs with open arm holes and a swaddling wrap include a swaddling wing with extremely strong hook-and-loop fasteners as arm restraints that restrict baby's ability to use his or her arms, which can be very dangerous for an older baby. Such swaddling wings or wraps can be dangerous because if baby rolls over and lands face down on the sleeping surface or mattress, the arm restraints will restrict baby's movements and prevent baby from lifting his or her upper body to reposition head and get access to air. In contrast, the Swaddle Sack allows freedom of arm movement, so that baby can successfully reposition his or her head should the baby turn face down.

This Swaddle Sack design is innovative and allows for supporting baby in a natural position with access to hands. It is very important for baby to be able to self-soothe and suck on his or her hands to communicate to caregiver that baby is hungry and ready to feed. Sucking vigorously on hands is a sign of hunger and the first baby cue. Crying is a late sign of hunger. Infant researchers and infant specialists believe the first communication between baby and caregiver is important, so the caregiver can respond appropriately and feed baby on this cue. This early act of cue met by feeding establishes trust, the foundation of healthy relationships. Lactation specialists believe this baby cue is important for breastfeeding mothers to help establish breastfeeding, milk let down and supply, and baby led feeding routines. Sucking on hands also helps the maturation of the infant's gastrointestinal tract, maturation of hand control, and also provides comfort to the baby. Sucking is the most organizing behavior to the baby, and helps with sleep/wake control. Additionally, babies have many nerve endings on their hands and around their mouth by which they learn, comfort, and communicate.

Prior designs allowed baby to suck on hands by sucking through the fabric, but baby care and lactation experts agree that it is important for baby to have direct skin-to-skin access to hands without a layer of fabric. In addition, given the risk that detergent and chemicals may be in the fabric after washing, it is safer and preferred for the baby to not suck on the fabric, which will minimize exposure and risk related to detergent and chemicals in the fabric.

The Swaddle Sack is designed to provide support as baby transitions from swaddling with arms fully restrained to a wearable blanket with no arm coverings and no sleeves, and the Swaddle Sack allows for a higher range of motion for baby's arms than prior swaddling device designs with arm restraints, so in the scenario where baby rolls over and lands in a facedown position on the sleeping surface, the Swaddle Sack upper section will allow baby's arms range-of-motion ("ROM") such that baby will be able to use his or her arms to lift its torso and reposition its head to get access to air.

Caregivers are strongly advised by the American Academy of Pediatrics to stop using a swaddling blanket or other swaddling device when baby shows signs of attempting to roll over or if baby can roll over, but there is always the risk that baby will roll over for the first time when baby is alone in a crib. Unfortunately, many caregivers do not follow the advice of the AAP, because when baby is ready to roll over, the caregiver may feel that baby is not ready for a loose-fitting, sleeveless wearable blanket. The design of the Swaddle Sack with swaddle snugness provides support and partial suppression of the Moro Reflex without arm restraints and includes sufficient ROM for baby's upper body which will reduce risk of suffocation for baby, in the event that baby rolls over to prone position, because baby will be able to use his or her arms to reposition his or her head to get access to air. The Swaddle Sack is the missing link in the newborn safe sleep care pathway and will be a safer option that will reduce the likelihood that parents will extend the use of swaddling devices with arm restraints that put baby at risk of accidental death from suffocation when baby unexpectedly rolls over, especially during the age of 3-4 months, when the risk of SIDS and SUIDS is highest.

In addition, the Swaddle Sack is designed to provide room for baby's hips and knees in the up and out position (flexed and abducted) and provide range of motion for baby's legs as recommended by the International Hip Dysplasia Institute while still providing support.

FIGS. 1A, 1B, 2A, and 2B are line drawings showing various views and configurations of a swaddling device 100 according to a first embodiment. The swaddling device 100 includes a neck opening 102, a first sleeve 104*a*, a second sleeve 104*b*, and a 2-way zipper 108 to allow ingress and egress for a baby.

Figure 1B:
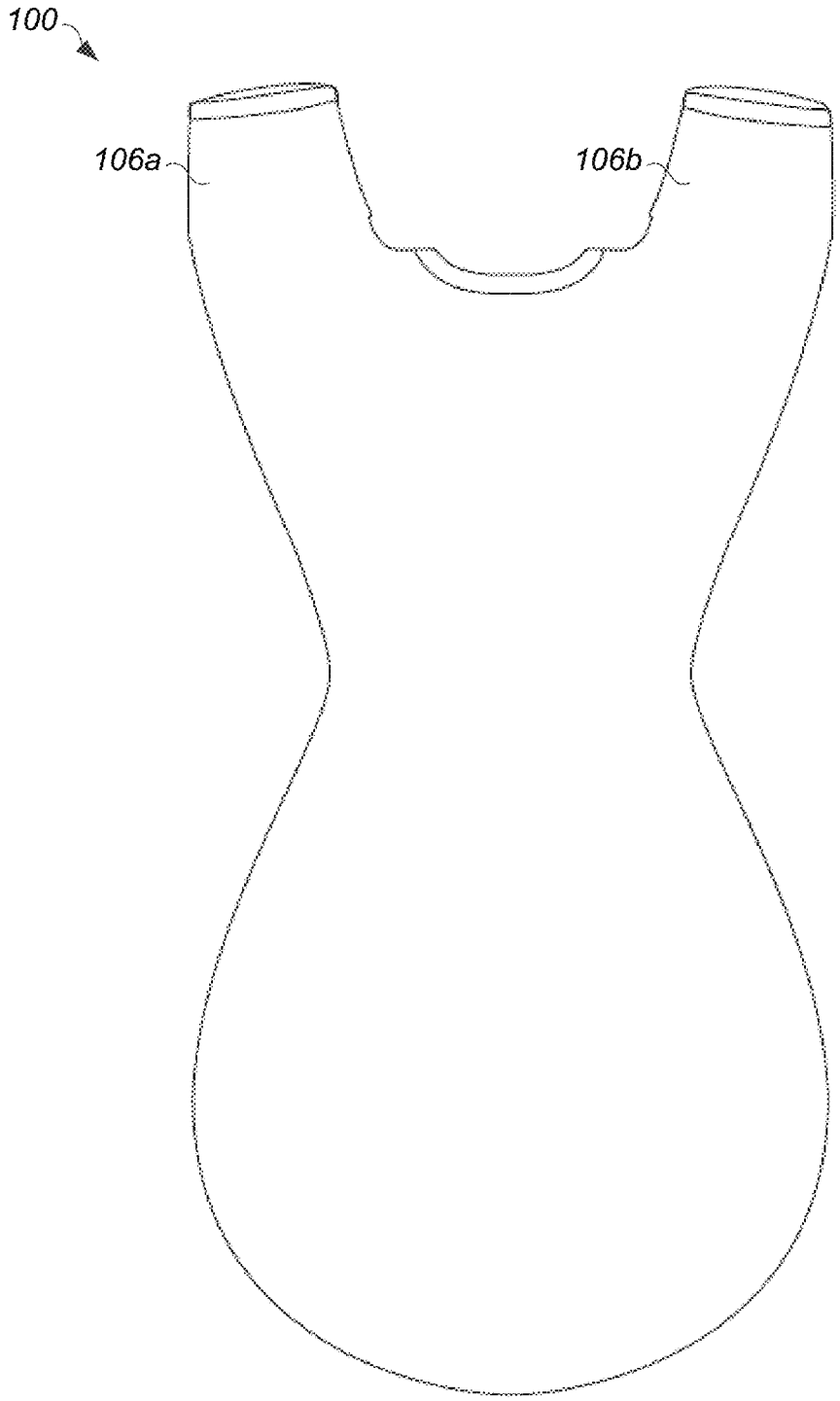

Each sleeve 104 includes a corresponding foldover mitten cuff 106 ("foldover cuff" or "cuff"). Each foldover cuff 106 is selectively openable by a caregiver. FIGS. 1A and 1B respectively show front and rear views of the device 100, with the cuffs 106 in the open position. In this position, the cuff 106 allows baby to extend a hand through the sleeve opening, thereby allowing baby to give baby cues and self-soothe by sucking on his or her hand(s).

Each cuff 106 is dimensioned so that when it is in the closed position, it is difficult if not impossible for the baby to open the cuff 106. As shown in FIG. 1A, each cuff 106 has a length that can be measured along a longitudinal axis of the corresponding sleeve. The cuff length is sufficiently long such that, when the cuff is closed, it forms a deep "pocket" that cannot easily be reversed by force applied to the end of the cuff by extension of the baby's hand/arm. The deep pocket further prevents the baby from wriggling its hand through the layers of material in the closed cuff 106. In some embodiments, each cuff 106 has a length of at least 2.5 and preferably 2.75 inches.

The sleeves of the swaddle sack are also dimensioned to keep the baby's hands closer to the baby's head and body. As can be seen in FIG. 1A, the length of each sleeve, measured from the shoulder of the device 100 to the end of the sleeve 104, is relatively short in comparison to the arm length of a typical baby. In some embodiments, the sleeves are between 3.0 and 4.0 inches in length. The short sleeve length (along with other features discussed herein) allows the device 100 to function as a transitional product between a swaddling blanket or swaddling device with arm restraints (for a newborn baby) and a sleeveless wearable blanket. The sleeves provide some constraint for the baby's arms, but not as much as would be provided by a swaddling blanket or a swaddling device which serves to lock down the baby's arms.

The sleeves extend upwards in a Y-shaped configuration with the distal ends above the shoulder line of the swaddling device 100. As noted above, the shorter than standard sleeves provide resistance if arms are fully extended with mitten cuffs closed. The sleeve shape is contoured to follow the arm position of a baby sleeping in a natural position with hands above its head. The sleeves each allow sufficient room for baby's arms and hands to be contained in the sleeve portion, thereby allowing baby to sleep in multiple natural positions including hands on chest, hands in-line with the shoulders with elbows by side of body, arms reaching above shoulders in the touchdown position. The sleeves allow for limited movement, and provide suppression of arm movements related to the Moro Reflex.

Figure 2A:
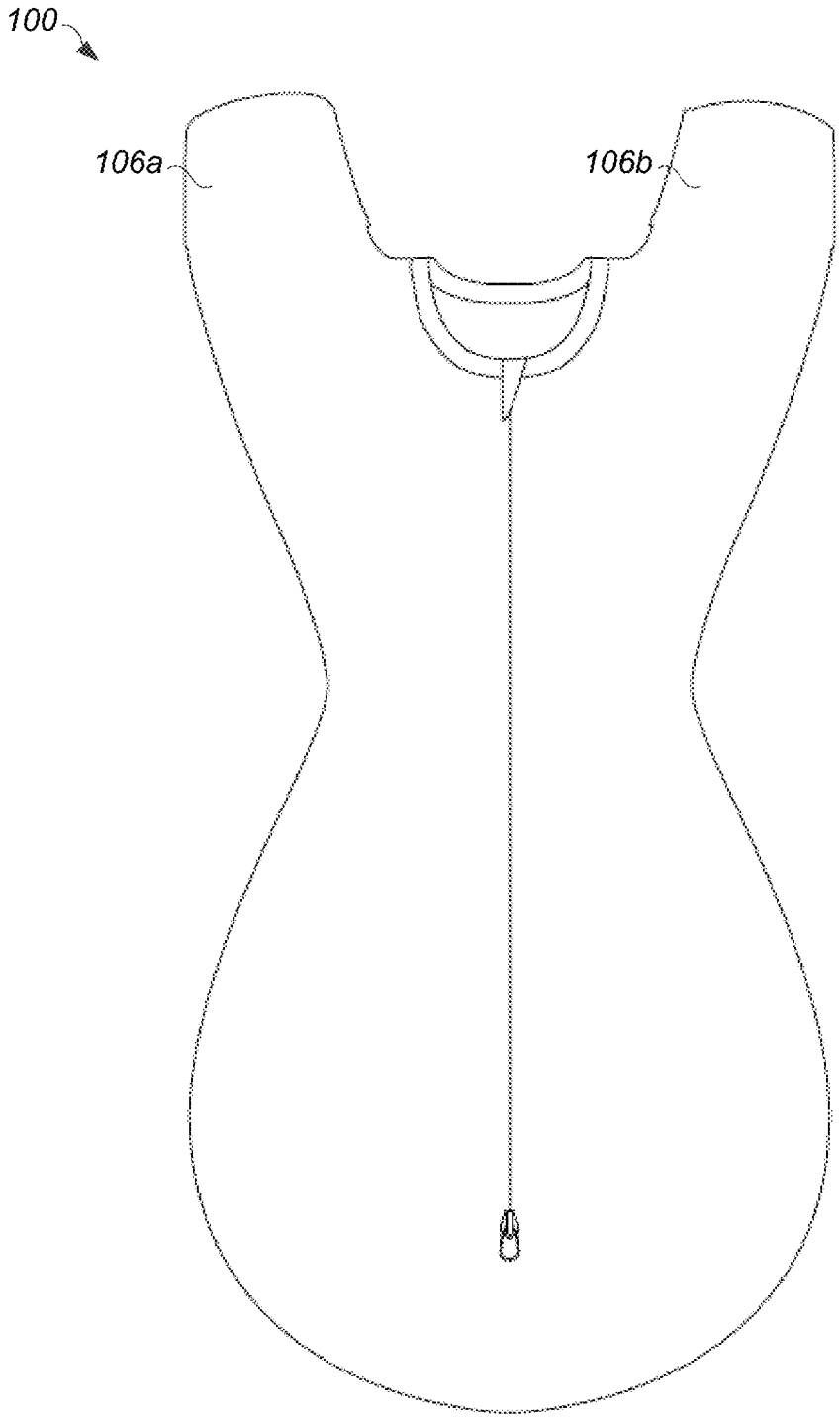
FIGS. 2A and 2B are line drawings showing front and rear views of the swaddling device according to the first embodiment, where its cuffs are in a closed position.
Figure 2B:
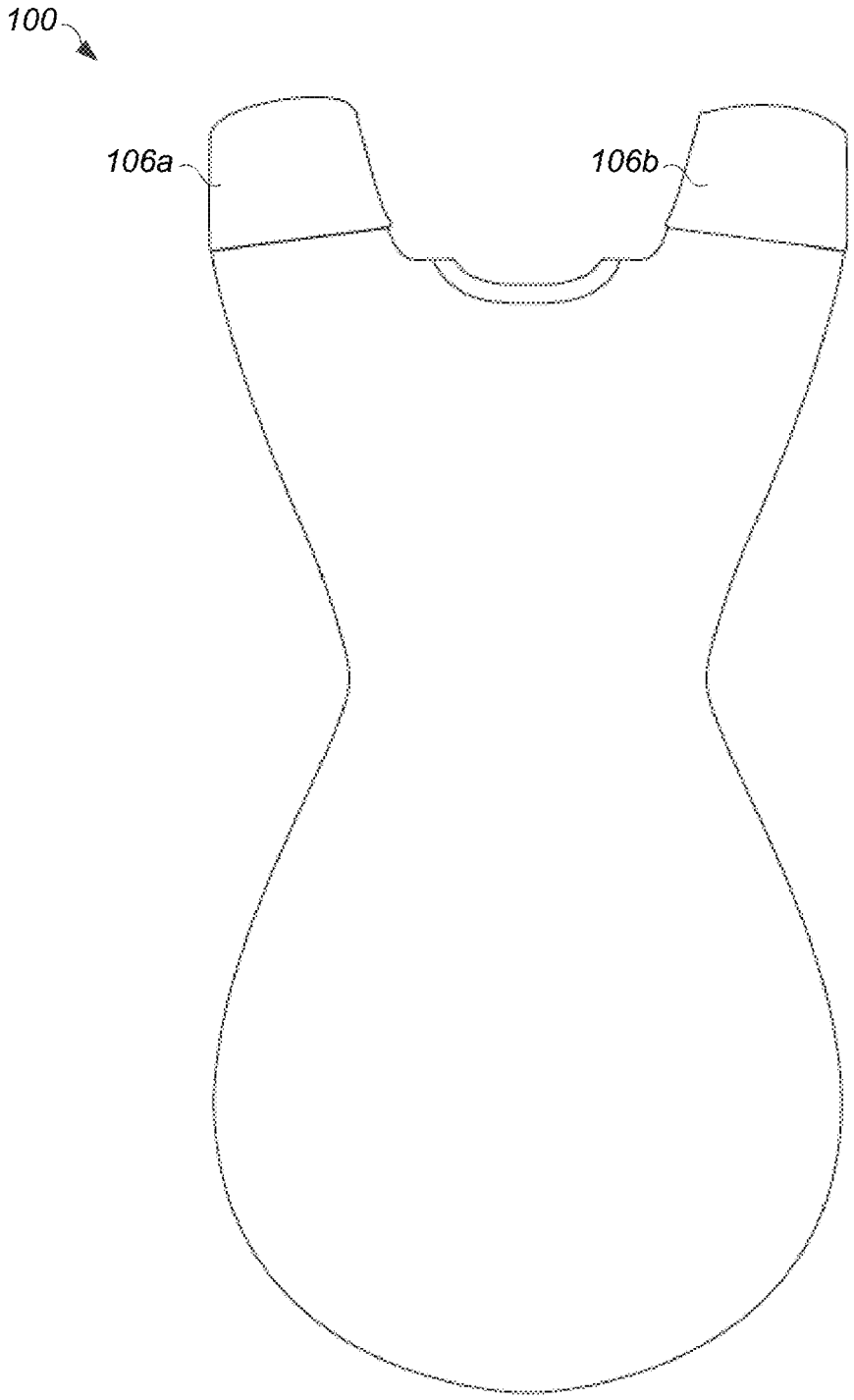

FIGS. 2A and 2B respectively show front and rear views of the device 100, with the cuffs 106 in the closed position. When the cuff 106 is in the closed position, it contains baby's hands in the sack to prevent the baby from extending his or her hands out of the sack for caregivers who are concerned with facial scratching. Note that in this and other embodiments, the foldover cuffs may be configured so that they are in the open position when folded from front to back (as shown) or so that they are in the open position when they are folded from back to front.

The swaddling device 100 is designed to support baby with swaddle-like support to suppress the Moro Reflex and allow baby to sleep on his or her back in a natural supported position with multiple arm position options, and enjoy the benefits of swaddling which include baby sleeps longer with fewer awakenings due to the Moro or startle reflex.

The swaddling device 100 includes three distinct sections or regions, each of which is optimized to provide one or more important functions or supports for the baby. In the bottom section (hips and legs), the device 100 is not tight around hips and legs, and allows hips and knees to flex, and provides ample room to move legs. In the middle section (torso), the device 100 is relatively snug to provide support around the mid-section, and tummy, which helps baby to feel secure. In the top section (chest, arms and hands), the device 100 is snug, but not overly tight, partially suppressing movements related to the Moro Reflex and allows for multiple arm position options for baby to sleep in a natural and comfortable position. Arm position options include: arms flexed and hands placed at mid-line inside the sack; arms-up and hands in-line with shoulders and inside the sack; arms-up and hands above the shoulders inside the sack; or arms-up and hands outside the sack and available to baby for skin-to-skin sucking for baby cues and to self-soothe.

FIGS. 3A, 3B, 4A, and 4B are line drawings showing various views and configurations of a swaddling device 300 according to a second embodiment. The swaddling device 300 includes the same features as the device 100 describe above. In addition, the device 300 includes baby soft hook-and-loop application to sleeves and chest region of the garment to secure the sleeves and arms at baby's mid-line with hands within reach of mouth.

Figure 3A:
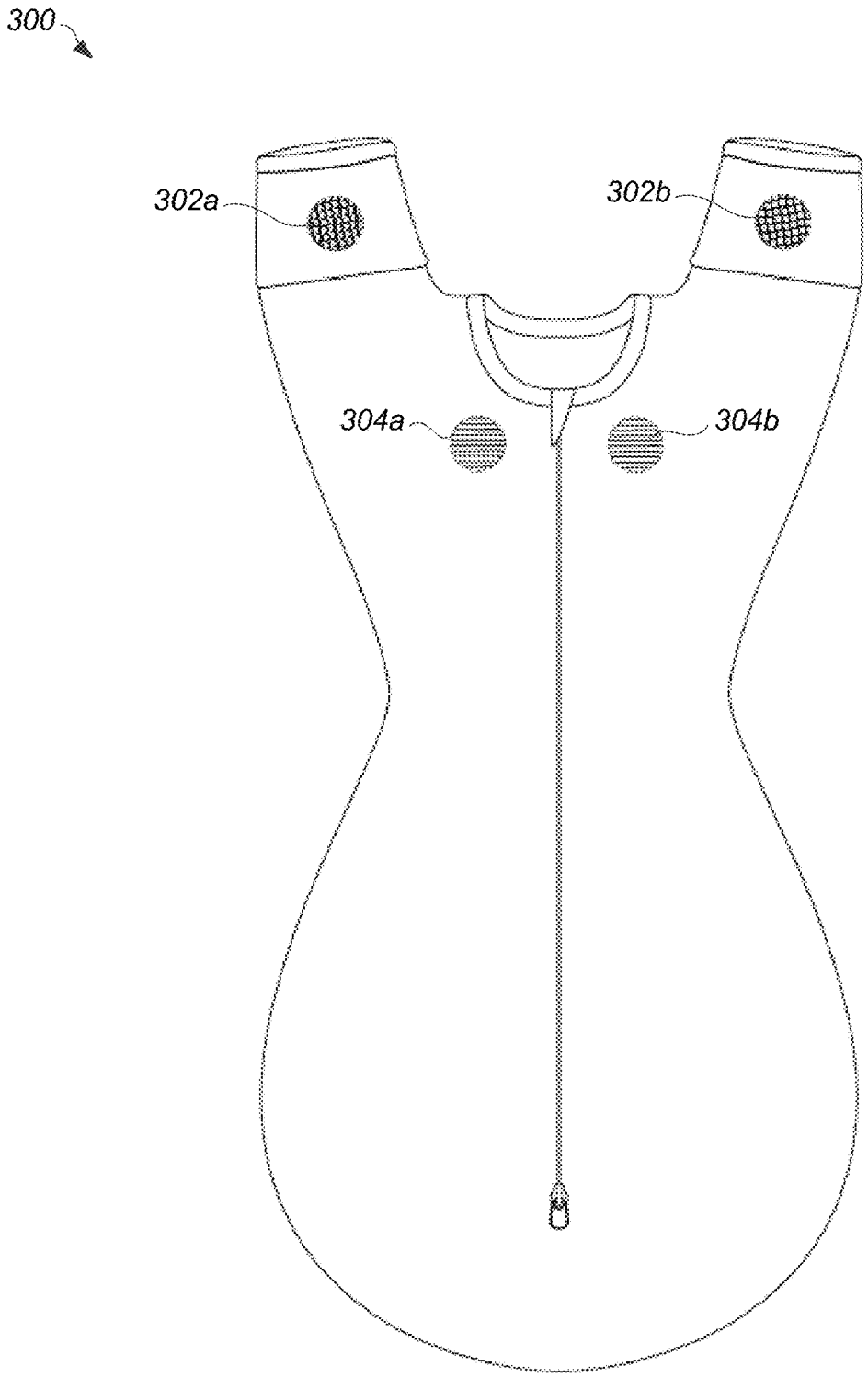
FIGS. 3A and 3B are line drawings showing front and rear views of a swaddling device according to a second embodiment, where its cuffs are in an open position.

As shown in FIG. 3A, the device 300 includes soft loop fasteners 302*a* and 302*b*, and soft hook fasteners 304*a* and 304*b*. This design option will put the baby in the traditional swaddle position with arms flexed, hands at mid-line, and hands up by face.

Figure 3B:
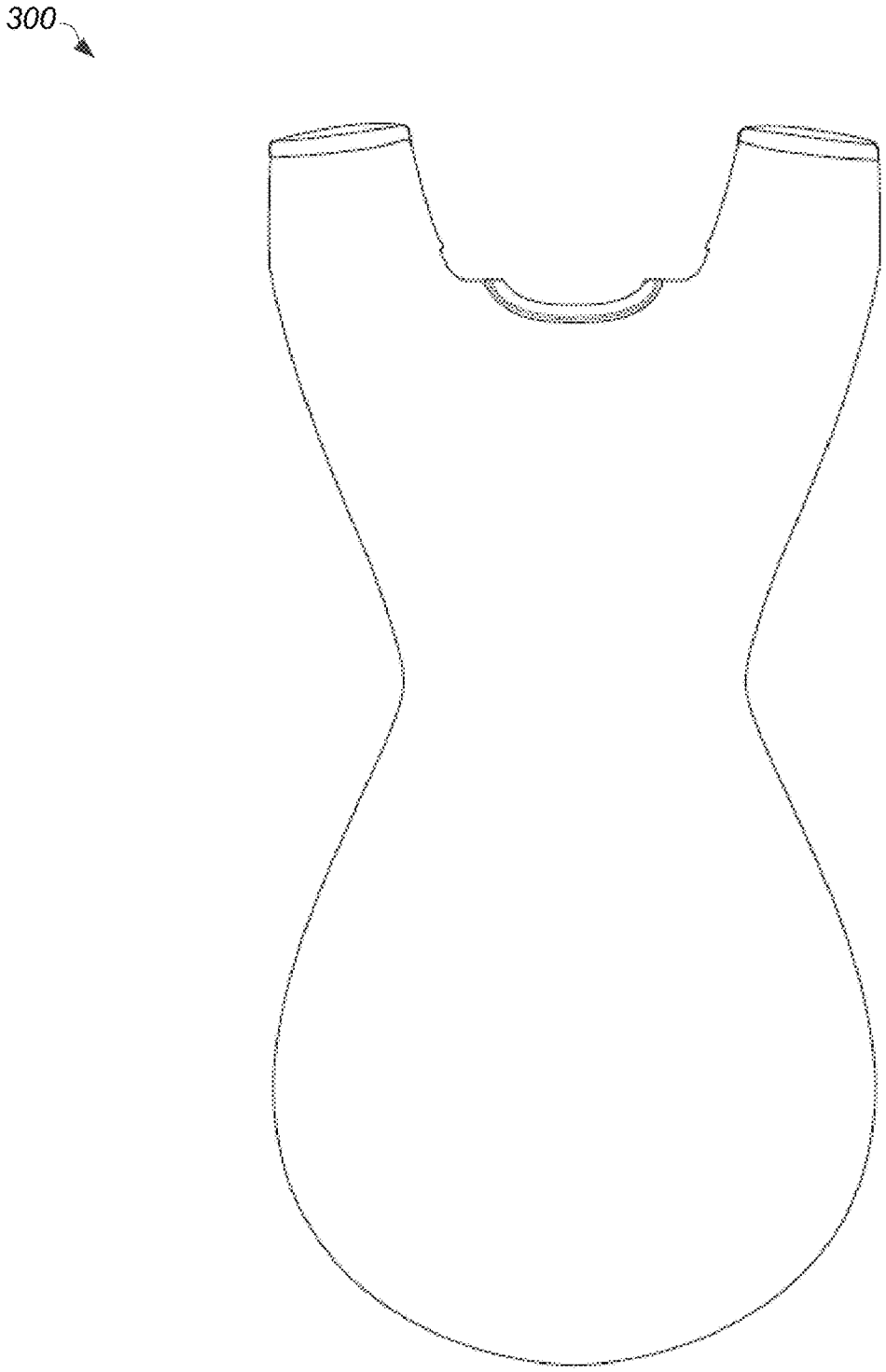
Figure 4A:
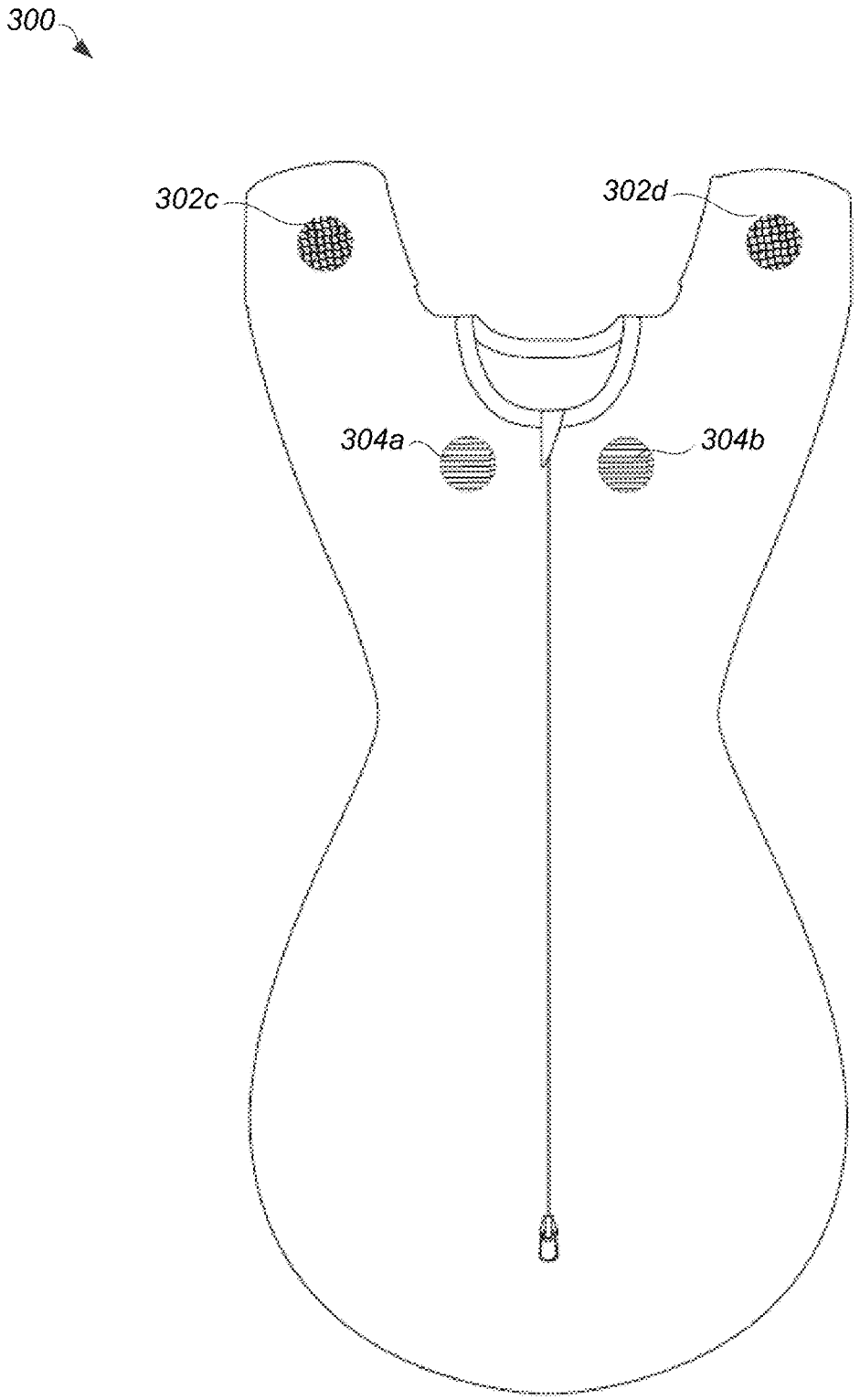
FIGS. 4A and 4B are line drawings showing front and rear views of the swaddling device according to the second embodiment, where its cuffs are in a closed position.
Figure 4B:
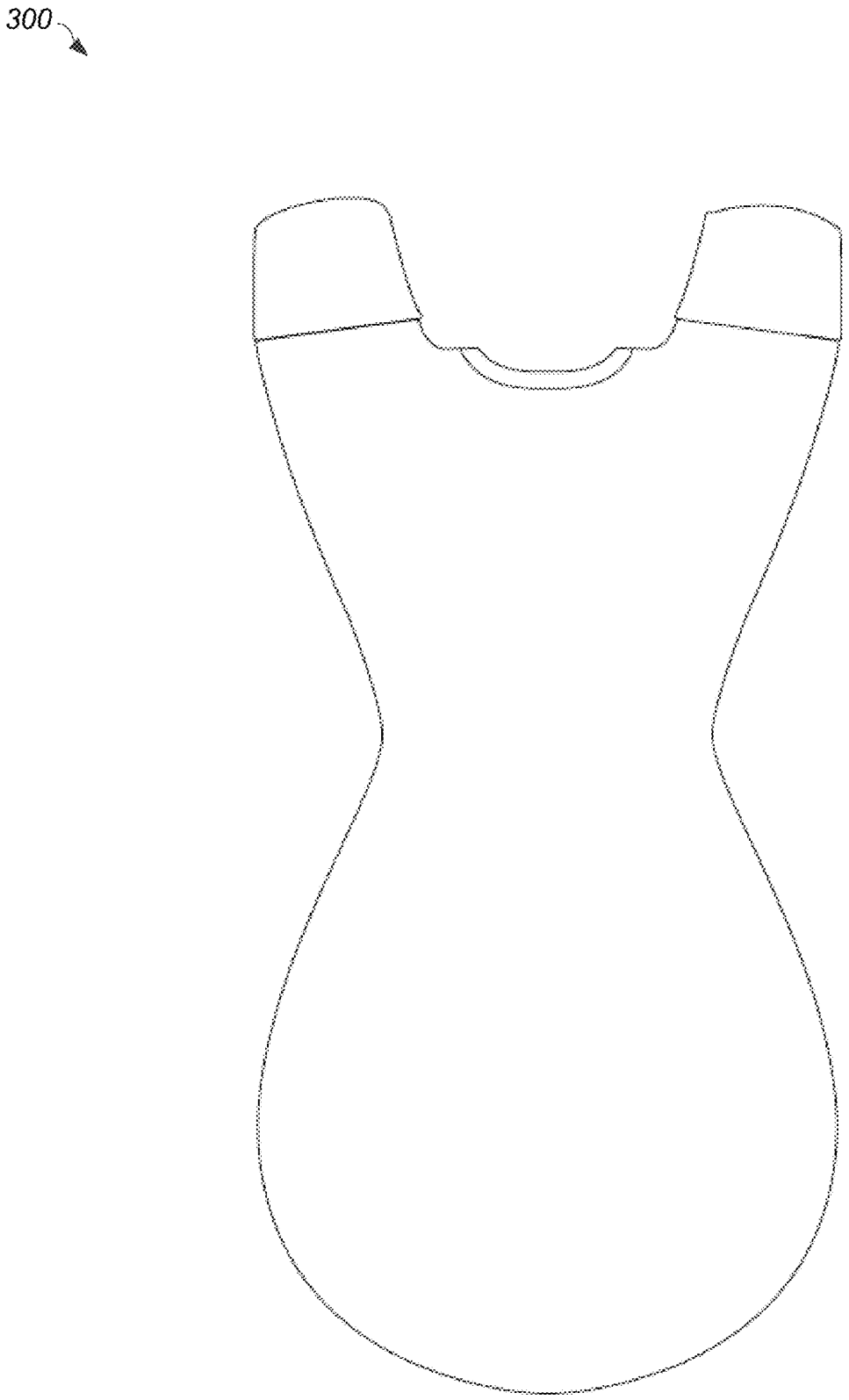

As with the first embodiment described above, this second embodiment allows for hands-in and hands-out configurations by way of foldover cuffs. FIGS. 3A and 3B respectively show front and rear views of the device with the cuffs in the open position. FIGS. 4A and 4B respectively show front and rear views of the device 300 with the cuffs in the closed position. Note in FIG. 4A that the device 300 further includes a second pair of soft hook fasteners 302*c* and 302*d*, so that the baby's arms can be attached to its midline when the mitten cuffs are in the closed position. The fasteners 302*c* and 302*d* are concealed underneath the cuff fabric when the cuffs are in the open position, and thus are not visible in FIG. 3A.

A third embodiment (not shown) includes open weave mesh over the chest region in addition to the baby soft hook-and-loop application to sleeves and chest area. The open mesh allows for extra air flow to help reduce risk of overheating. This design variation includes baby soft hook-and-loop application to sleeves and chest region of the garment to secure the sleeves and arms at baby's mid-line with hands within reach of mouth. This design option will put the baby in the traditional swaddle position with arms flexed and hands at mid-line, and hands up by face. The third embodiment also provides for hands-in and hands-out configurations by way of foldover mitten cuffs.

Figure 5A:
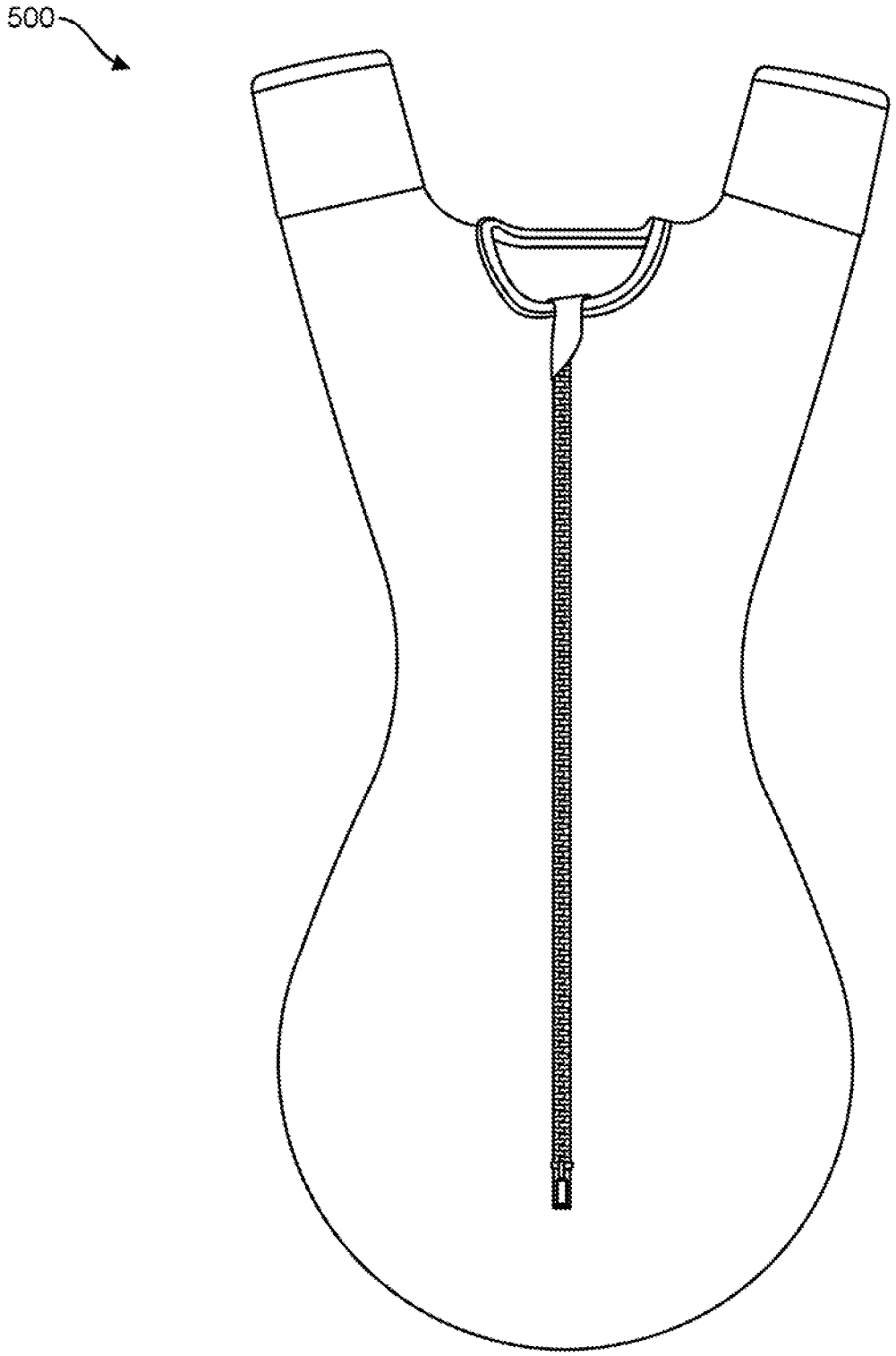
FIGS. 5A and 5B are images showing front and rear views of the swaddling device according to the first embodiment.
Figure 5B:
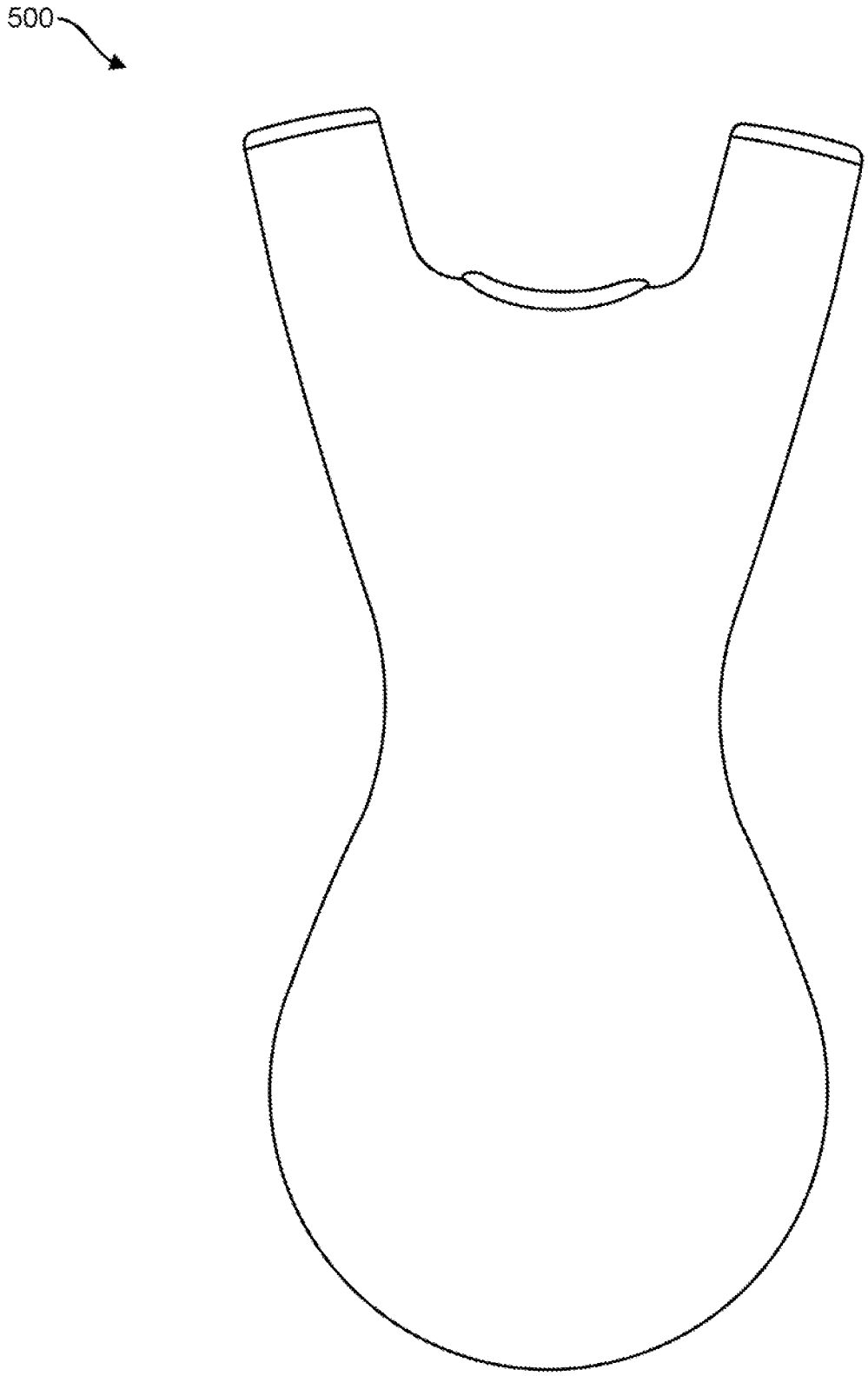

FIGS. 5A and 5B are photographs respectively showing a front and rear view of an example swaddling device 500. Here, the foldover cuffs are shown in the open position. This and other embodiments may be manufactured largely from a front and rear fabric panel, sewn together along the respective perimeters of the panels. The fabric panels are made from a soft and stretchy cotton or substantially cotton-based fabric. In some cases the fabric may include a synthetic elastic fiber, such as elastane.

Figure 6:
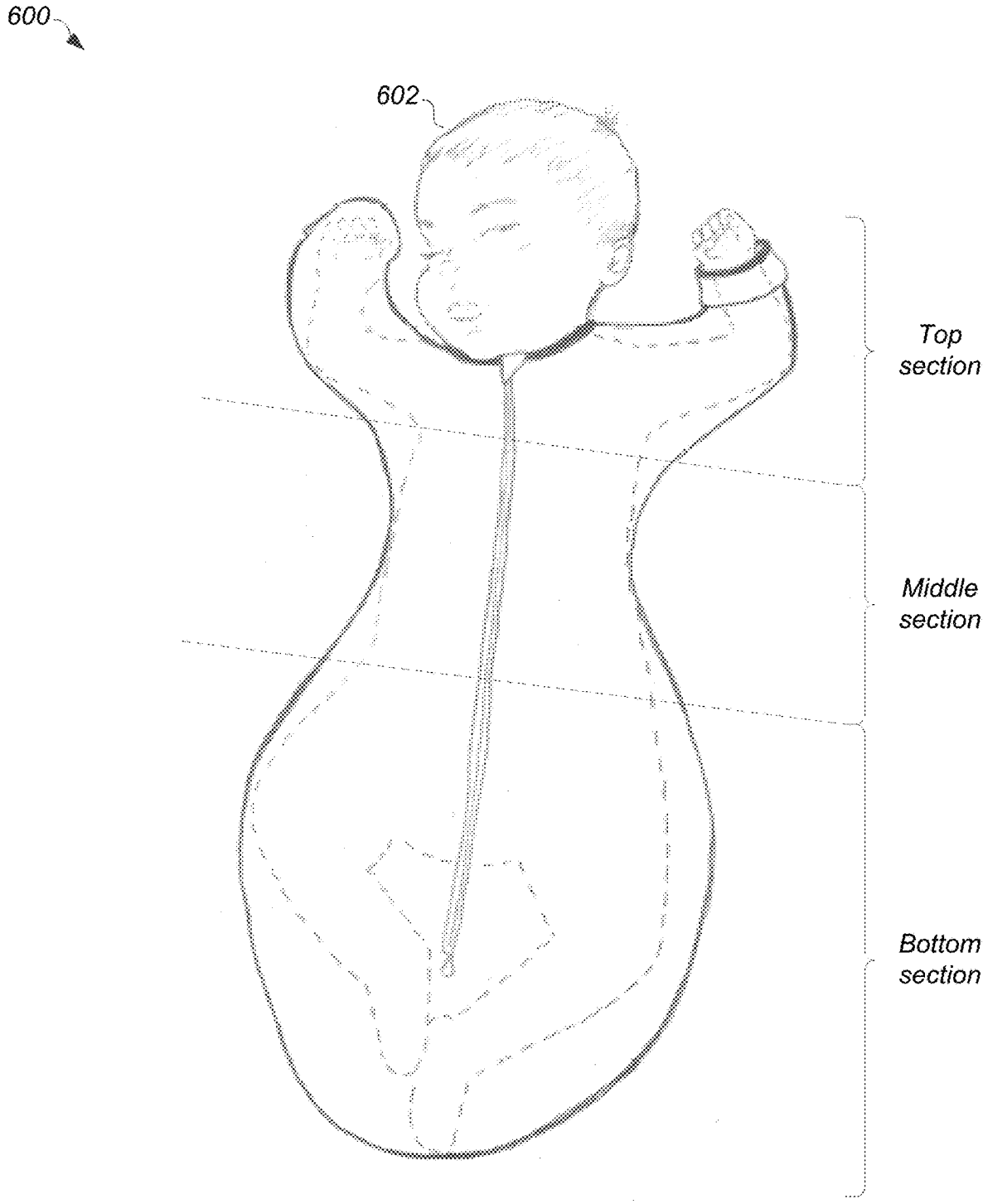
FIG. 6 is a line drawing showing a baby in an example embodiment of the swaddling device.

FIG. 6 is a line drawing showing a baby 602 within a swaddling device 600 according to an example embodiment. Note that the baby's left hand is exposed, while its right hand is securely contained within the openable sleeve.

FIG. 6 also illustrates the relative dimensions of the top, middle, and bottom sections with respect to the size of the baby's body, shown in dashed lines inside of the device 600. In the top section, the sleeves and chest of the device 600 are relatively tight, so as to reduce and suppress upper body movements associated with the Moro Reflex. In the middle section, the device 600 is relatively snug about the baby's stomach region. The snugness in this region helps baby feel secure. In the bottom section, the device 600 is sufficiently spacious so as to allow baby's hips and knees to flex, while reducing and suppressing lower body movements associated with the Moro Reflex.

The top, middle, and bottom sections of the swaddling device are dimensioned to sizes that have been determined by the inventors to provide the advantages described above, including suppression of the Moro Reflex, hip health, and the like. In some embodiments, the middle section of the swaddling device has a circumference in the range 14-17 inches, where the circumference varies depending on whether the device is constructed for a preemie, newborn, or older baby size. The circumference of the middle section is designed to be 5-10% less than the circumference of the baby's stomach. The smaller circumference, coupled with the use of stretchy fabric construction, provides moderate constant pressure on the stomach of the baby.

In contrast to the dimensions of the middle section, the maximum circumference of the bulb-shaped bottom section may be in the range 21-26 inches. In relative terms, the maximum circumference of the bottom section is at least 40% larger than the average circumference of the middle section. In typical embodiments, the maximum circumference of the bottom section is about 50% larger than the average circumference of the middle section. In some embodiments, the middle section is substantially cylindrical in shape, in that its circumference does not vary by more than 10% throughout. In other embodiments, as seen in FIG. 1A, the middle section has a narrower waist than its top and bottom ends.

Figure 7:
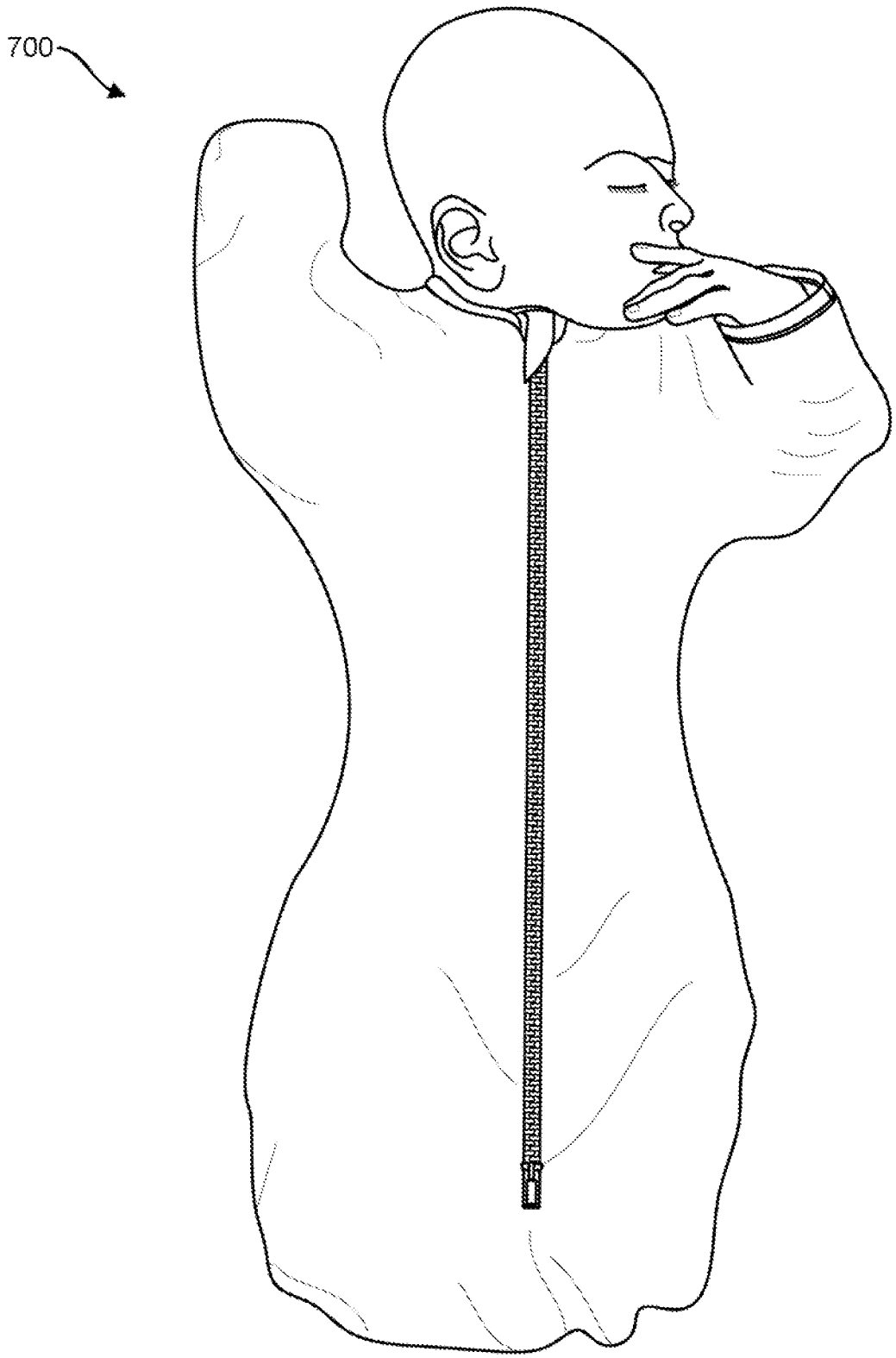
FIG. 7 is an image showing a baby in an example embodiment of the swaddling device.

FIG. 7 is a photograph a baby within a swaddling device 700. Note that the baby's left hand is exposed, while its right hand is securely contained within the openable sleeve. Here, the device 700 allows the baby to obtain skin-to-skin contact by placing its hand in or about its mouth.

While embodiments of the invention have been illustrated and described, as noted above, many changes can be made without departing from the spirit and scope of the invention. Accordingly, the scope of the invention is not limited by the above disclosure.

The invention claimed is:

1. A swaddling device, comprising:

a one-piece sack that has a top section, a middle section, and a bottom section, wherein the one-piece sack is configured to substantially enclose a baby, wherein the one-piece sack includes:

a neck opening;

a first sleeve portion positioned on a first side of the neck opening; and a second sleeve portion positioned on a second side of the neck opening, wherein the first and second sleeve portions each have a proximal end beginning at a shoulder line of the swaddling device and a distal end above the shoulder line of the swaddling device, wherein the distance between the distal ends is greater than the distance between the proximal ends, wherein each of the first and the second sleeve portion have a foldover mitten cuff at the distal end that is selectively openable by a caregiver, wherein each of the foldover mitten cuffs is closed by turning cuff material over an opening at the distal end and blocking use of the distal end opening, wherein each of the foldover mitten cuffs is opened by turning cuff material back on itself to allow access to the exterior of the swaddling device through the distal end of each of the first and second sleeve portions, wherein each foldover mitten cuff is at least 2.5 inches in length, measured along a longitudinal axis of each of the first and second sleeve portions, wherein each sleeve portion is configured to:

expose a hand of the baby outside of the sleeve portion when the foldover mitten cuff is in an open position; and enclose the hand of the baby within the sleeve portion when the foldover mitten cuff is in a closed position, wherein the sleeve portions each have a sleeve length of between 3 and 4 inches and are configured to partially restrict motion of arms of the baby when hands of the baby are inside the sleeve portion with the foldover mitten cuff in the closed position by preventing the cuffs from opening in response to force applied from hands or arms of the baby, wherein the sleeve length is structured to enable a range of motion of the baby's arms upwards beyond the ears of the baby, and wherein the length of the sleeve portions in combination with the length of the foldover mitten cuffs reduce suffocation risk when the baby is in a prone position by still allowing a range of motion of the baby's arms sufficient to enable use of the baby's arms to lift its torso to reposition its head to access air yet allow access to the baby's mouth to self-soothe, and wherein the one-piece sack is configured to:

partially restrict movement of the baby and thereby partially suppress the Moro Reflex; and envelop the torso of the baby and thereby provide pressure to the mid-section of the baby, the one-piece sack thereby providing a transitional swaddling device, that enables the baby to wear both sleeves simultaneously in combination with one or both open or closed foldover mitten cuffs to transition a baby out of swaddling yet still provide partial suppression of the Moro Reflex.

2. The swaddling device of claim 1, wherein the middle section has a mean circumference that is smaller than a mean circumference of the bottom section, wherein the middle section is configured to envelop the mid-section of the baby and thereby provide pressure to the mid-section of the baby, and wherein the bottom section is configured to provide room for the baby to flex its knees and hips while limiting the range of motion and provide partial suppression of the Moro Reflex.

3. The swaddling device of claim 1, wherein the bottom section has a mean circumference that is 50 percent greater than a mean circumference of the middle section.

4. The swaddling device of claim 1, wherein the sleeve portions are configured to be shorter than the length of the baby's arms to provide resistance if the baby's arms are fully extended with the foldover mitten cuffs closed, wherein the sleeve portions are configured to contain the baby's arms and hands in the sleeve portion when the foldover mitten cuffs are in the closed position, thereby allowing baby to sleep with one or both hands on chest, hands in-line with the shoulders with elbows by side of body, or arms reaching above shoulders in the touchdown position, and wherein the sleeves are configured to allow for limited movement, provide suppression of arm movements related to the Moro Reflex, and still enable use of the baby's arms to lift its torso to reposition its head when the baby is in a prone position.

5. The swaddling device of claim 1, wherein the sleeve portions each are configured to: allow baby to access and place his or her bare hands in mouth when the foldover mitten cuffs are open; and allow baby to access and place his or her covered hands in mouth when the foldover mitten cuffs are closed.

6. The swaddling device of claim 1, wherein the one-piece sack includes a two-way zipper that is configured to provide ingress for the baby into the one-piece sack and egress for the baby out of the one-piece sack.

7. The swaddling device of claim 6, wherein the zipper runs from the neck opening downward through the middle section of the one-piece sack and to the bottom section of the one-piece sack.

8. The swaddling device of claim 1, wherein the one-piece sack is made using a soft and stretchy cotton fabric, and wherein a front side of the one-piece sack includes an open weave mesh panel for enhanced airflow.

9. The swaddling device of claim 8, wherein the cotton fabric includes a synthetic elastic fiber.

10. The swaddling device of claim 1, wherein the one-piece sack includes at least one hook and loop fastener portion positioned above the middle section of the one-piece sack, and wherein each of the sleeve portions includes a hook and loop fastener portion that is configured to be removably attached to at least one hook and loop fastener portion of the one-piece sack.

11. The swaddling device of claim 1, wherein the one-piece sack is formed from a top panel and a bottom panel, wherein each panel is a continuous piece of fabric.

12. A swaddling device, comprising:

a sack that is configured to enclose a baby, wherein the sack includes a top section, a middle section, and a bottom section;

wherein the bottom section has a circumference that is larger than a circumference of the middle section, wherein the bottom section is configured to allow the baby to flex its hips and knees, while partially restricting movement of the legs;

wherein the top section includes a first sleeve and a second sleeve that each have a foldover mitten cuff at a distal end that is selectively openable, wherein each foldover mitten cuff is at least 2.5 inches in length, measured along a longitudinal axis of a respective sleeve, wherein each foldover mitten cuff is configured to:

expose a hand of the baby when the foldover mitten cuff is in an open position; and enclose the hand of the baby in the sleeve when the foldover mitten cuff is in a closed position;

wherein the first and second sleeves are configured to point upwards and away from the shoulders of the baby; and wherein the sleeves each have a sleeve length of between 3 and 4 inches and are configured to partially restrict motion of arms of the baby when hands of the baby are inside the sleeves with the foldover mitten cuffs in the closed position by preventing the cuffs from opening in response to force applied from hands or arms of the baby, and wherein the length of the first and second sleeves in combination with the length of the foldover mitten cuffs reduce suffocation risk by still allowing a range of motion of the baby's arms sufficient to enable use of the baby's arms to lift its torso to reposition its head when the baby is in a prone position yet maintain proximity to the baby's head for sucking on hands to self-soothe, wherein the top section is configured to:

partially restrict the movement of the arms of the baby and thereby suppress arm movements and startles related to the Moro Reflex; and enable use of the baby's arms to lift its torso to reposition its head, the sack thereby providing a transitional swaddling device that enables wearing of both sleeves in combination with one open foldover mitten to transition the baby out of swaddling.

13. The swaddling device of claim 12, wherein the middle section has a mean circumference between 14 and 17 inches and is configured to provide pressure on baby's mid-section, wherein the bottom section has a mean circumference that is 50% greater than the circumference of the middle section.

14. The swaddling device of claim 12, wherein the bottom section has a mean circumference that is 50 percent greater than a mean circumference of the middle section.

15. The swaddling device of claim 12, wherein each of the foldover mitten cuffs is closed by turning cuff material over an opening at the distal end and blocking use of the distal end opening, wherein each of the foldover mitten cuffs is opened by turning cuff material of the sleeve back on itself to allow access to the exterior of the swaddling device through the distal end of the sleeve.

16. The swaddling device of claim 12, wherein the sack is made using a soft and stretchy fabric that is a blend of cotton and elastane.

17. The swaddling device of claim 1, wherein the middle section has a circumference between 14 and 17 inches, wherein the bottom section has a maximum circumference between 21 and 26 inches.

18. The swaddling device of claim 1, wherein the bottom section has a maximum circumference between 21 and 26 inches, and wherein the maximum circumference of the bottom section is 50% greater than a mean circumference of the middle section.

* * * * *